US007794627B2

(12) United States Patent
Park et al.

(10) Patent No.: US 7,794,627 B2
(45) Date of Patent: Sep. 14, 2010

(54) PASTE COMPOSITION, DISPLAY DEVICE INCLUDING THE SAME, AND ASSOCIATED METHODS

(75) Inventors: Sang Hee Park, Anyang-si (KR); Deok Young Choi, Gunpo-si (KR); Byung Cheol Lee, Busan (KR); Hee In Nam, Suwon-si (KR); Hyun Don Kim, Anyang-si (KR)

(73) Assignee: Cheil Industries, Inc., Gumi-si, Kyeongsangbuk-do (KR)

( * ) Notice: Subject to any disclaimer, the term of this patent is extended or adjusted under 35 U.S.C. 154(b) by 0 days.

(21) Appl. No.: 12/081,565

(22) Filed: Apr. 17, 2008

(65) Prior Publication Data

US 2008/0261077 A1 Oct. 23, 2008

(30) Foreign Application Priority Data

Apr. 18, 2007 (KR) ..... 10-2007-0038012

(51) Int. Cl.
*H01B 1/00* (2006.01)

(52) U.S. Cl. ..... 252/500; 252/511; 428/426

(58) Field of Classification Search ..... 252/519.33, 252/500, 511; 106/1.19; 165/104.15; 428/434, 428/426; 445/24

See application file for complete search history.

(56) References Cited

U.S. PATENT DOCUMENTS

| | | | | |
|---|---|---|---|---|
| 5,616,173 | A * | 4/1997 | Okamoto et al. | 106/1.19 |
| 6,210,805 | B1 * | 4/2001 | Sunahara | 428/434 |
| 7,381,353 | B2 * | 6/2008 | Lee et al. | 252/511 |
| 2004/0259452 | A1 * | 12/2004 | Matsumoto et al. | 445/24 |
| 2005/0016714 | A1 * | 1/2005 | Chung | 165/104.15 |
| 2006/0202174 | A1 * | 9/2006 | Barker et al. | 252/519.33 |
| 2006/0266984 | A1 * | 11/2006 | Lee et al. | 252/500 |

* cited by examiner

*Primary Examiner*—Mark Kopec
*Assistant Examiner*—Khanh Tuan Nguyen
(74) *Attorney, Agent, or Firm*—Lee & Morse, P.C.

(57) ABSTRACT

A paste composition for an electrode includes a conductive material, a colored glass frit, the glass frit exhibiting a blackness (L*) value of about 85 or less, a binder, and a solvent.

19 Claims, 1 Drawing Sheet

PASTE COMPOSITION, DISPLAY DEVICE INCLUDING THE SAME, AND ASSOCIATED METHODS

BACKGROUND OF THE INVENTION

1. Field of the Invention

Embodiments of the present invention relate to a paste composition, a display device including the same, and associated methods. More particularly, embodiments of the present invention relate to a paste composition including colored frit glass for electrodes of a display device.

2. Description of the Related Art

A display device may display images on a screen by applying voltage to electrodes between two substrates, so light may be emitted toward the screen to form the images thereon. For example, the conventional display device, e.g., a plasma display panel (PDP) device, may display images by applying voltage via electrodes to a discharge gas between two substrates, e.g., neon gas, xenon gas, helium gas, argon gas, and/or a mixture thereof, so the discharge gas may be excited to trigger emission of light from photoluminescent layers between the two substrates.

The electrodes of the conventional display device may include a conductive material. In addition, some of the conventional electrodes may include a black pigment to absorb external light. For example, bus electrodes of the conventional display device may have a multi-layer structure, e.g., a Cr/Cu/Cr structure, formed via a vacuum deposition/etching process. In another example, the bus electrodes of the conventional display device may include a black layer, i.e., a layer including the black pigment, and a conductive layer formed separately or simultaneously, i.e., as a double-layer or as a single layer, by printing and/or photolithography.

Electrodes having a multi-layer structure, e.g., a Cr/Cu/Cr structure formed via a vacuum deposition/etching process, however, may require long processing and expensive equipment and materials, and may cause environmental pollution during etching. Electrodes including a black layer, however, may require long processing, e.g., performing printing/drying processes twice for double-layered electrodes, may potentially cause electrode defects, e.g., due to heterogeneity between the black and conductive layers, may have increased resistance due to use of the black pigment, and may have reduced blackness, e.g., when an amount of black pigment is low as compared to an amount of a conductive metal used to provide conductivity.

SUMMARY OF THE INVENTION

Embodiments of the present invention are therefore directed to a paste composition, an electrode including the same, and a display device including the same, which substantially overcome one or more of the disadvantages and shortcomings of the related art.

It is therefore a feature of an embodiment of the present invention to provide a paste composition with colored frit glass that exhibits increased blackness and conductivity.

It is another feature of an embodiment of the present invention to provide a display device with electrodes of a paste composition with colored frit glass that exhibits increased blackness and conductivity.

It is yet another feature of an embodiment of the present invention to provide a method of forming a display device with electrodes of a paste composition with colored frit glass that exhibits increased blackness and conductivity.

At least one of the above and other features and advantages of the present invention may be realized by providing a paste composition for an electrode, including a conductive material, a colored glass frit, the colored glass frit exhibiting a blackness (L*) value of about 85 or less, a binder, and a solvent. The composition may include the conductive material in an amount of about 30% to about 90% by weight of a total weight of the paste composition, the colored glass frit in an amount of about 1% to about 20% by weight of the total weight of the paste composition, the binder in an amount of about 1% to about 20% by weight of the total weight of the paste composition, and the solvent.

The conductive material may include powder of one or more of gold, silver, copper, nickel, palladium, platinum, and/or aluminum. The colored glass frit may include a metal oxide, the metal oxide including one or more of cobalt, manganese, chromium, copper, iron, aluminum, nickel, zinc, ruthenium, and/or rhodium. The metal oxide may be present in the colored glass frit in an amount of about 0.1% to about 20% by weight, based on a total weight of the colored glass frit. The colored glass frit may have a softening temperature of about 300° C. to about 600° C. The binder may include one or more of an acryl-based polymer and/or a cellulose-based polymer. The solvent may have a boiling point of about 120° C. or higher. The solvent may include one or more of cellosolve, ethyl cellosolve, butyl cellosolve, aliphatic alcohols, α-terpineol, β-terpineol, dihydro-terpineol, ethylene glycol, ethylene glycol monobutyl ether, butyl cellosolve acetate, and/or texanol.

The composition may further include a black pigment. The composition may further include a photopolymerizable compound and a photoinitiator. The paste composition may include the photopolymerizable compound in an amount of about 1% to about 20% by weight of the total paste composition and the photoinitiator in an amount of about 0.1% to about 10% by weight of the total paste composition. The composition may further include at least one additive, the additive being one or more of a UV stabilizer, a viscosity stabilizer, an antifoaming agent, a dispersant, a leveling agent, an antioxidant, and/or a thermal polymerization inhibitor.

At least one of the above and other features and advantages of the present invention may be also realized by providing a display device, including a front substrate facing a rear substrate, and a plurality of first electrodes between the front and rear substrates, the first electrodes including a paste composition having a conductive material, a colored glass frit exhibiting blackness (L*) value of about 85 or less, a binder, and a solvent. The plurality of first electrodes may be bus electrodes and/or address electrodes. The display device may further include a plurality of second electrodes between the front and rear substrates, the plurality of second electrode being transparent electrodes on the front substrate along a first direction. The display device may be a plasma display panel.

At least one of the above and other features and advantages of the present invention may be further realized by providing a method of manufacturing a display device, including forming a plurality of first electrodes between front and rear substrates, the first electrodes having a paste composition, wherein the paste composition includes, a conductive material, a colored glass frit exhibiting blackness (L*) value of about 85 or less, a binder, and a solvent.

BRIEF DESCRIPTION OF THE DRAWINGS

The above and other features and advantages of the present invention will become more apparent to those of ordinary skill in the art by describing in detail exemplary embodiments thereof with reference to the attached drawings, in which.

DETAILED DESCRIPTION OF THE INVENTION

Figure 1:
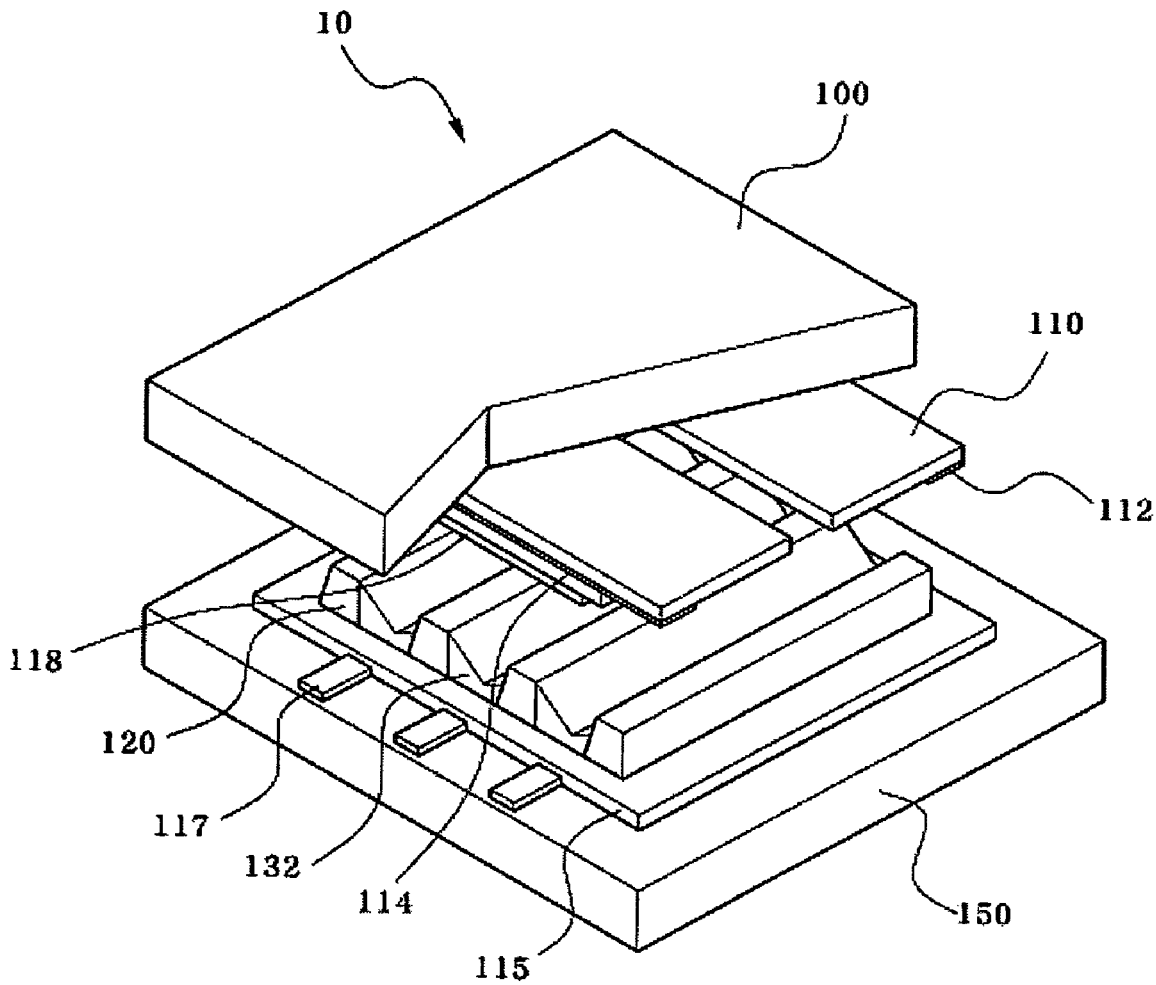
FIG. 1 illustrates a partial perspective view of a display device according to an embodiment of the present invention.

Korean Patent Application No. 10-2007-0038012, filed on Apr. 18, 2007, in the Korean Intellectual Property Office, and entitled: "Paste Composition for Electrode Fabrication Comprising Colored Glass Frit, and Plasma Display Panel Including the Electrode Fabricated Using the Same," is incorporated by reference herein in its entirety.

Embodiments of the present invention will now be described more fully hereinafter with reference to the accompanying drawings, in which exemplary embodiments of the invention are illustrated. Aspects of the invention may, however, be embodied in different forms and should not be construed as limited to the embodiments set forth herein. Rather, these embodiments are provided so that this disclosure will be thorough and complete, and will fully convey the scope of the invention to those skilled in the art.

In the figures, the dimensions of elements and regions may be exaggerated for clarity of illustration. It will also be understood that when an element is referred to as being "on" another element or substrate, it can be directly on the other element or substrate, or intervening elements may also be present. In addition, it will also be understood that when an element is referred to as being "between" two elements, it can be the only element between the two elements, or one or more intervening elements may also be present. Like reference numerals refer to like elements throughout.

As used herein, the expressions "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C" and "A, B, and/or C" includes the following meanings: A alone; B alone; C alone; both A and B together; both A and C together; both B and C together; and all three of A, B, and C together. Further, these expressions are open-ended, unless expressly designated to the contrary by their combination with the term "consisting of." For example, the expression "at least one of A, B, and C" may also include an $n^{th}$ member, where n is greater than 3, whereas the expression "at least one selected from the group consisting of A, B, and C" does not.

As used herein, the terms "a" and "an" are open terms that may be used in conjunction with singular items or with plural items. For example, the term "an additive" may represent a single compound, e.g., a viscosity stabilizer, or multiple compounds in combination, e.g., a viscosity stabilizer and a polymerization inhibitor.

In accordance with an embodiment of the present invention, a paste composition for an electrode may include a conductive material, a colored glass frit, a binder, and a solvent.

The conductive material may be any suitable conductive material. For example, the conductive material may be a metal powder, e.g., an organic conductive powder, an inorganic conductive powder, and so forth, an alloy powder, and so forth. Examples of the conductive material may include one or more of gold, silver, copper, nickel, palladium, platinum, and/or aluminum. If the conductive material is used in powder form, an average particle size of the powder, i.e., an average diameter $D_{50}$, may be determined with respect to a desired thickness of a deposited paste. For example, $D_{50}$ may be about 0.1 μm to about 3 μm. The conductive material may be present in the paste composition in an amount of about 30% to about 90% by weight of a total weight of the paste composition. For example, the conductive material may be present in the paste composition in an amount of about 50% to about 80% by weight of the total paste composition.

When the amount of the conductive material in the paste composition is less than about 30% by weight, resistance of the resultant electrode may be increased. An increase of the resistance of the resultant electrode may decrease discharge voltage in electrodes formed of the paste composition, thereby deteriorating luminance of a display device including the electrodes. When the amount of the conductive material in the paste composition is more than about 90% by weight, relative amounts of other components in the paste composition, e.g., colored glass frit and binder, may be reduced, thereby decreasing cohesiveness of the paste composition and deteriorating adhesiveness of the paste composition with respect to a substrate, e.g., a glass substrate.

The colored glass frit of the paste composition may be any suitable colored glass frit exhibiting blackness (L*) of about 85 or less. When the blackness (L*) is more than about 85, the colored glass frit may be insufficiently dark, so electrodes formed of the paste composition may reflect external light. It is noted that a decrease in L* value indicates an increase in dark color, such that low L* values indicate blacker colors.

The colored glass frit may include one or more types of glass frit with different softening temperatures, so a softening temperature of the colored glass frit may be about 300° C. to about 600° C., as determined by differential thermal analysis (DTA). When the softening temperature is less than about 300° C., reactivity problems with a substrate may occur, e.g., the glass frit may penetrate the substrate. When the softening temperature is more than about 600° C., a wetting property of the glass may be deteriorated. An amount of the colored glass frit in the paste composition may be about 1% to about 20% by weight of the total paste composition. For example, the amount of the colored glass frit in the paste composition may be about 3% to about 15% by weight of the total paste composition. When the amount of the colored glass frit in the paste composition is less than about 1% by weight, adhesiveness between the paste composition and the substrate may be deteriorated. When the amount of the colored glass frit in the paste composition is more than about 20% by weight, resistance of the resultant electrode may be increased.

The colored glass frit may include one or more metal oxides. Examples of metal oxides in the colored glass frit may include one or more of cobalt oxide, manganese oxide, chromium oxide, copper oxide, iron oxide, aluminum oxide, nickel oxide, zinc oxide, ruthenium oxide, and/or rhodium oxide. The metal oxide may be present in the colored glass frit in an amount of about 0.1% to about 20% by weight of a total weight of the colored glass frit. When the amount of the metal oxide in the colored frit glass is less than about 0.1% by weight, blackness of the paste composition may be insufficient. When the amount of the metal oxide in the colored frit glass is more than about 20% by weight, the softening temperature of the colored glass frit after firing and the resistance of the resultant electrode may be increased.

The binder of the paste composition may be any suitable organic binder, and may bind the conductive material with the colored glass frit, e.g., the conductive material and the colored glass frit may be dispersed within the binder. The binder may provide adhesiveness between the paste composition and the substrate during printing, drying, and/or firing. Examples of the binder may include one or more of acryl-based polymers copolymerized from acrylic monomers having hydrophilicity, e.g., a carboxyl group for imparting alkali-developability, and/or cellulose-based polymers. The cellulose-based polymers may include one or more of ethyl cellulose, hydroxyethyl cellulose, hydroxypropyl cellulose, and/or hydroxyethyl-hydroxypropyl cellulose.

The binder may be present in the paste composition in an amount of about 1% to about 20% by weight of the total paste composition. For example, the binder may be present in the paste composition in an amount of about 3% to about 15% by weight of the total paste composition. When the amount of the binder in the paste composition is less than about 1% by weight, viscosity of the paste composition may be lowered and/or adhesiveness of the paste composition with respect to the substrate after printing and drying may be deteriorated. When the amount of the binder in the paste composition is more than about 20% by weight, the binder may not completely decompose and/or evaporate during firing of the paste composition, thereby increasing resistance of the resultant electrode.

The solvent of the paste composition may be any suitable solvent having a boiling point of about 120° C. or higher. Examples of solvents may include one or more of methyl cellosolve, ethyl cellosolve, butyl cellosolve, an aliphatic alcohol, α-terpineol, β-terpineol, dihydro-terpineol, ethylene glycol, ethylene glycol monobutyl ether, butyl cellosolve acetate, and/or texanol. An amount of solvent in the paste composition may vary in accordance with a specific application of the paste composition, e.g., the viscosity of the paste composition may be controlled by adjusting the amount of the solvent in the paste composition. For example, the solvent may be present in the paste composition in an amount of about 1% to about 68% by weight of the total paste composition.

The paste composition may include small amounts of black pigment to improve blackness. Examples of black pigments may include metal oxides having iron, cobalt, copper, chromium, manganese, aluminum, and/or nickel as a main component. If black pigment is added, it may be used in an amount of up to about 20 parts by weight based on 100 parts by weight of the paste composition. When the amount of black pigment in the paste composition is more than about 20 parts by weight, the resistance of the resultant electrode may increase.

The paste composition may further include additives in order to improve, e.g., flow, processability, stability, and so forth, of the paste composition. Examples of additives may include one or more of a ultraviolet (UV) light stabilizer, a viscosity stabilizer, an antifoaming agent, a dispersant, a leveling agent, an antioxidant, and/or a thermal polymerization inhibitor.

The paste composition may be used to form an electrode via, e.g., screen printing, offset printing, and/or photolithography. If photolithography is used to form an electrode of the paste composition, the paste composition may further include a photopolymerizable compound and a photoinitiator.

The photopolymerizable compound may be a multifunctional monomer or oligomer used in a photosensitive resin composition. Examples of suitable photopolymerizable compounds may include one or more of ethylene glycol diacrylate, triethylene glycol diacrylate, 1,4-butanediol diacrylate, 1,6-hexanediol diacrylate, neopentyl glycol diacrylate, pentaerythritol diacrylate, pentaerythritol triacrylate, dipentaerythritol diacrylate, dipentaerythritol triacrylate, dipentaerythritol pentaacrylate, dipentaerythritol hexaacrylate, bis-phenol A diacrylate, trimethylolpropane triacrylate, novolac epoxy acrylate, ethylene glycol dimethacrylate, diethylene glycol dimethacrylate, triethylene glycol dimethacrylate, propylene glycol dimethacrylate, 1,4-butanediol dimethacrylate, and/or 1,6-hexanediol dimethacrylate.

The photopolymerizable compound may be present in the paste composition in an amount of about 1% by weight to about 20% by weight based on 100% by weight of the paste composition. When the amount of the photopolymerizable compound in the paste composition is less than about 1% by weight, photo curing may not be complete, thereby causing defective pattern development during electrode formation. When the amount of the photopolymerizable compound in the paste composition is more than about 20% by weight, the photopolymerizable compound may not sufficiently decompose and/or evaporate during firing, thereby increasing resistance of the resultant electrode.

The photoinitiator of the paste composition may be any suitable photoinitiator exhibiting photo-reactivity at, e.g., a UV wavelength of about 200 nm to about 400 nm. Examples of photoinitiators may include benzophenone-based compounds, acetophenone-based compounds, triazine-based compounds, and/or mixtures thereof. The photoinitiator may be present in the paste composition in an amount of about 0.1% by weight to about 10% by weight based on 100% by weight of the paste composition.

According to another embodiment of the present invention, a display device may include electrodes formed of the paste composition. For example, as illustrated in FIG. 1, a plasma display panel (PDP) device may be manufactured. It is noted, however, that even though a PDP device is described herein, other types of display devices are within the scope of the present invention using the paste composition described previously.

As illustrated in FIG. 1, a PDP 10 may include front and rear substrates 100 and 150 facing each other and spaced apart, a plurality of first electrodes 110, a plurality of second electrodes 117, barrier ribs 120, and photoluminescent layers 132. The front and rear substrates 100 and 150 may be any suitable substrates, e.g., glass substrates.

The first electrodes 110, e.g., discharge electrodes, may be arranged along a first direction, e.g., a horizontal direction, on the front substrate 100 to face the rear substrate 150. The first electrodes 110 may be transparent, e.g., formed of indium tin oxide (ITO), and may be parallel to each other. The first electrodes 110 may include bus electrodes 112 thereon to face the rear substrate 115. For example, one bus electrode 112 may be formed on each first electrode 110, so the bus electrode 112 may be between the first electrode 110 and the rear substrate 115. The bus electrodes 112 may extend along the first electrodes 110. Two first electrodes 110 with corresponding bus electrodes 112 thereon may be a pair of discharge sustaining electrodes.

The bus electrodes 112 of the PDP may include a high conductivity material to minimize resistance of the transparent electrodes 110. Further, the bus electrodes 112 may be narrow to obtain a required line resistance, and may include an opaque material in order to reduce reflection of external light. Accordingly, the bus electrodes 112 may be formed of the paste composition according to embodiments described previously by, e.g., screen printing, offset printing, and/or photolithography.

For example, the bus electrodes may be formed by photolithography as follows. The paste composition described previously may be mixed and coated on a glass substrate to a thickness of about 5 μm to about 40 μm, followed by solidification thereof, e.g., drying the paste composition at a temperature of about 80° C. to about 150° C. for about 20 minutes to about 60 minutes to form a film. Next, a UV exposure process using a photomask may be performed on the film, followed by developing the film through the photomask to pattern the film into the bus electrodes 112. The patterned film may be dried and fired at a temperature of about 400° C. to about 700° C., e.g., at about 500° C. to about 600° C.

A first dielectric layer 114 may be formed on the first electrodes 110 and/or the bus electrodes 112, e.g., between the bus electrodes 112 and the rear substrate 115, for preserving charges generated inside the PDP 10. A protective layer 118 may be formed of, e.g., magnesium oxide (MgO), on the first dielectric layer 114 to face the rear substrate 115, to protect the first dielectric layer 114, to increase secondary electron emission during discharge, and to increase wall charge retention.

The second electrodes 117 of the PDP 10, e.g., address electrodes, may be arranged along a second direction, e.g., a vertical direction, on the rear substrate 150 to face the front substrate 100. The address electrodes 117 may be formed of the paste composition described previously by a substantially same method as the bus electrodes 112. The second electrodes 117 may intersect with the first electrodes 110. A second dielectric layer 115 may be formed on the second electrodes 117.

The barrier ribs 120 may be formed between the front and rear substrates 100 and 150, e.g., between the first and second dielectric layers 114 and 115, to define a plurality of discharge cells (not shown), e.g., to correspond to a plurality of red (R), green (G), and/or blue (B) pixels. The discharge cells may correspond to intersection points of the first and second electrodes 110 and 117. A discharge gas, e.g., neon gas, xenon gas, helium gas, argon gas, and/or a mixture thereof, may be injected into the discharge cells. Each of the discharge cells may be discharged selectively by application of voltage to the discharge gas therein.

The photoluminescent layers 132 may be formed in the discharge cells. Accordingly, when voltage, i.e., a threshold voltage or higher, is applied to the discharge cells, the discharge gas may trigger excitation of the photoluminescent layers 132, so R, G, and/or B light may be emitted from the photoluminescent layers 132 toward the front substrate 100.

EXAMPLES

Example 1 a mixture was prepared by mixing 60 g of silver (Ag) powder having an average particle size of 1.5 μm (AG-2-11, Dowa Hightech Co., Ltd., Japan), 8 g of colored glass frit having blackness (L*) of 45 (LF546B, Particlogy Co., Ltd., Korea), and 6.5 g of poly(methyl methacrylate-co-methacrylic acid) (P-118, Nippon Synthetic Chemical Industry Co., Ltd, Japan). A solvent was prepared and added to the mixture by mixing 4.5 g of trimethylolpropane ethoxy triacrylate (Miwon Commercial Co., Ltd.), 2 g of 2-methyl-4'-(methylthio)-2-morpholino-propiophenone (Sartomer Co., Ltd.), and 19 g of texanol (Eastman Chemical Company, USA). The above components were dispersed in the poly (methyl methacrylate-co-methacrylic acid) using a 3 roll mill to prepare a paste composition.

Example 2 a paste composition was prepared in the same manner as in Example 1, with the exception of using SCBF-02 having blackness (L*) of 57 (Samwha Electronics), instead of LF546B, as a colored glass frit.

Example 3 a paste composition was prepared in the same manner as in Example 1, with the exception of using BK-76 having blackness (L*) of 68 (NHY Co., Ltd.), instead of LF546B, as a colored glass frit.

Example 4 a paste composition was prepared in the same manner as in Example 1, with the exception of using 3 g of $CO_2O_3$ black pigment (CX-100, Mitsui Mining Co., Ltd.) in addition to the LF546B, and using 16 g of texanol, instead of 19 g of texanol, as a solvent.

Comparative Example 1 a paste composition was prepared in the same manner as in Example 1, with the exception of using 8 g of non-colored glass frit (OMX-1184F, Tokan Material Technology Co., Ltd.) and 3 g of $CO_2O_3$ black pigment (CX-100, Mitsui Mining Co., Ltd.), instead of the colored glass frit, and 16 g of texanol, instead of 19 g of texanol, as a solvent.

Comparative Example 2 a paste composition was prepared in the same manner as in Example 1, with the exception of using 1184F having blackness (L*) of 92 (Tokan Material Technology Co., Ltd.), instead of LF546B, as a colored glass frit.

Formulations of the compositions of Examples 1-4 and Comparative Examples 1-2 are listed in Table 1 below.

TABLE 1

| | | Glass frit | | | | | | | |
|---|---|---|---|---|---|---|---|---|---|
| | Silver powder [g] | Colored [g] | Non-colored [g] | Blackness [L*] | Black pigment [g] | Organic binder [g] | Functional monomer [g] | Photoinitiator [g] | Solvent [g] |
| Ex. 1 | 60 | 8 | — | 45 | — | 6.5 | 4.5 | 2 | 19 |
| Ex. 2 | 60 | 8 | — | 57 | — | 6.5 | 4.5 | 2 | 19 |
| Ex. 3 | 60 | 8 | — | 68 | — | 6.5 | 4.5 | 2 | 19 |
| Ex. 4 | 60 | 8 | — | 45 | 3 | 6.5 | 4.5 | 2 | 16 |
| Comp. Ex. 1 | 60 | — | 8 | N/A | 3 | 6.5 | 4.5 | 2 | 16 |
| Comp. Ex. 2 | 60 | 8 | — | 92 | — | 6.5 | 4.5 | 2 | 19 |

The compositions were used to prepare electrodes. Each paste composition of Examples 1-4 and Comparative Examples 1-2 was deposited on a substrate, followed by drying at about 100 C.° to about 200 C.° and firing at about 450 C.° to about 600 C.° to form an electrode pattern. Then, the resistivity and blackness were evaluated for each formed electrode. Results are presented in the following Table 2.

(1) Resistivity Measurement

Each paste composition of Examples 1-4 and Comparative Examples 1-2 was used to form an electrode pattern via photolithography. Resistance of each electrode was measured using a line resistance meter (2000 Multimeter, by Keithley Instrument Inc.). Next, a line width, thickness, and length of each electrode were measured using a profiler (P-10, by KLA-Tencor Corp.). Next, resistivity was determined according to Equation 1 below. A lower resistivity value indicated a lower line resistance in the panel. A lower line resistance provided reduced discharge voltage, so luminance was improved.

$$\text{Resistivity}(\mu\Omega * \text{cm}) = \frac{\text{Line Resistance } (\mu\Omega) * \text{thickness (cm)} * \text{width (cm)}}{\text{length (cm)}} \quad \text{Equation 1}$$

(2) Blackness (L*) Measurement

Each paste composition of Examples 1-4 and Comparative Examples 1-2 was printed onto a glass substrate using a screen printing method, followed by drying at 120 C.° for 20 minutes. Next, each dried paste composition on a substrate was fired at 560 C.° for 1.5 hours to form an electrode having a thickness of 5.2 μm (allowable thickness range may be about 5 μm to about 6 μm). Next, blackness (L*) was measured using a spectrophotometer (CM-508i, by Minolta Co., Ltd.). The blackness value of an electrode was important for determining reflected luminance of external light and brightness.

TABLE 2

| | Resistivity (μΩ · cm) | Blackness of electrodes (L*) |
|---|---|---|
| Example 1 | 2.3 | 49 |
| Example 2 | 2.1 | 51 |
| Example 3 | 2.2 | 54 |
| Example 4 | 4.1 | 42 |
| Comparative Example 1 | 4.3 | 60 |
| Comparative Example 2 | 2.5 | 67 |

As seen in Table 2, electrodes of Examples 1-4, i.e., electrodes formed of a paste composition according to embodiments of the present invention exhibited excellent blackness (L*) values, while maintaining low resistivity. In particular, Examples 1-3, i.e., electrodes including no black pigment, exhibited both excellent blackness (L*) values and resistivity values. As can be seen in Example 4, use of a black pigment may increase resistivity.

As further seen in Table 2, use of a non-colored glass frit with a black pigment, i.e., Comparative Example 1, provided an electrode with an increased L* value, i.e., a less black electrode. Further, use of colored glass frit having a very high L* value, i.e., approximately transparent glass frit, in Comparative Example 2 also provided an electrode with increased L* value.

Accordingly, as seen from Examples 1-4 and Comparative Examples 1-2, good conductivity and reduced L* values may be achieved by forming electrodes of a paste composition according to embodiments of the present invention. Such electrodes may have improved light absorption, so luminance of reflected external light may be minimized.

The paste composition according to embodiments of the present invention may be advantageous in providing high conductivity and excellent blackness (L* values). Accordingly, an electrode formed of the paste composition may have excellent conductivity, and may have superior reflected luminance of external light due to its blackness (L*) value, even without including an additional black pigment. As a result, the paste composition may be capable of improving luminance by reducing reflection of external light, without reducing a discharge voltage of a display device.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A paste composition for an electrode, comprising:

a conductive material in an amount of about 30% to about 90% by weight of a total weight of the paste composition;

a colored glass frit in an amount of about 1% to about 20% by weight of the total weight of the paste composition, the colored glass frit exhibiting a blackness (L*) value of about 85 or less;

a binder in an amount of about 1% to about 20% by weight of the total weight of the paste composition; and a solvent.

2. The composition as claimed in claim 1, wherein the colored glass frit includes at least one metal oxide.

3. The composition as claimed in claim 2, wherein a total amount of the metal oxide in the colored glass frit is about 0.1% to about 20% by weight, based on a total weight of the colored glass frit.

4. The composition as claimed in claim 1, wherein the conductive material includes powder of one or more of gold, silver, copper, nickel, palladium, platinum, and/or aluminum.

5. The composition as claimed in claim 1, wherein the colored glass frit has a softening temperature of about 300° C. to about 600° C.

6. The composition as claimed in claim 1, wherein the binder includes one or more of an acryl-based polymer and/or a cellulose-based polymer.

7. The composition as claimed in claim 1, wherein the solvent has a boiling point of about 120° C. or higher.

8. The composition as claimed in claim 7, wherein the solvent includes one or more of cellosolve, ethyl cellosolve, butyl cellosolve, aliphatic alcohols, α-terpineol, β-terpineol, dihydro-terpineol, ethylene glycol, ethylene glycol monobutyl ether, butyl cellosolve acetate, and/or texanol.

9. The composition as claimed in claim 1, further comprising a black pigment.

10. The composition as claimed in claim 1, further comprising a photopolymerizable compound and a photoinitiator.

11. The composition as claimed in claim 10, wherein the paste composition includes the photopolymerizable compound in an amount of about 1% to about 20% by weight of the total weight of the paste composition and the photoinitiator in an amount of about 0.1% to about 10% by weight of the total weight of the paste composition.

12. The composition as claimed in claim 1, further comprising at least one additive, the additive being one or more of a UV stabilizer, a viscosity stabilizer, an antifoaming agent, a dispersant, a leveling agent, an antioxidant, and/or a thermal polymerization inhibitor.

13. The composition as claimed in claim 1, wherein the composition includes:

the conductive material in an amount of about 40% to about 70% by weight of a total weight of the paste composition; and the colored glass frit in an amount of about 3% to about 20% by weight of the total weight of the paste composition, the colored glass frit exhibiting the blackness (L*) value within a range of about 85 to about 30.

14. The composition as claimed in claim 1, wherein the composition includes:

the conductive material in the amount of about 55% to about 65% by weight of a total weight of the paste composition; and the colored glass frit in the amount of about 5% to about 10% by weight of the total weight of the paste composition, the colored glass frit exhibiting the blackness (L*) value within a range of about 70to about 40.

15. A display device, comprising:

a front substrate facing a rear substrate; and a plurality of first electrodes between the front and rear substrates, the first electrodes having a paste composition including:

a conductive material in an amount of about 30% to about 90% by weight of a total weight of the paste composition, a colored glass frit in an amount of about 1% to about 20% by weight of the total weight of the paste composition, the colored glass frit exhibiting blackness (L*) value of about 85 or less, a binder in an amount of about 1% to about 20% by weight of the total weight of the paste composition, and a solvent.

16. The display device as claimed in claim 15, wherein the plurality of first electrodes are bus electrodes and/or address electrodes.

17. The display device as claimed in claim 16, further comprising a plurality of second electrodes between the front and rear substrates, the plurality of second electrode being transparent electrodes on the front substrate along a first direction.

18. The display device as claimed in claim 15, wherein the display device is a plasma display panel.

19. A method of manufacturing a display device, comprising:

forming a plurality of first electrodes between front and rear substrates, the first electrodes being formed using a paste composition, wherein:

the paste composition includes:

a conductive material in an amount of about 30% to about 90% by weight of a total weight of the paste composition, a colored glass frit in an amount of about 1% to about 20% by weight of the total weight of the paste composition, the colored glass frit exhibiting a blackness (L*) value of about 85 or less, a binder in an amount of about 1% to about 20% by weight of the total weight of the paste composition, and a solvent.

* * * * *